US006761544B2

(12) United States Patent
McCartney

(10) Patent No.: US 6,761,544 B2
(45) Date of Patent: Jul. 13, 2004

(54) LUBRICATION SYSTEM FOR DOWNHOLE APPLICATION

(75) Inventor: Patrick M. McCartney, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 34 days.

(21) Appl. No.: 09/829,248

(22) Filed: Apr. 9, 2001

(65) Prior Publication Data

US 2002/0146336 A1 Oct. 10, 2002

(51) Int. Cl.[7] ..... F04B 17/00

(52) U.S. Cl. ..... 417/423.3; 417/423.12; 417/423.13; 184/27.1; 184/31

(58) Field of Search ..... 417/423.3, 423.12, 417/424.2; 184/27.1, 31, 5.1; 310/90; 384/398

(56) References Cited

U.S. PATENT DOCUMENTS 3,975,117 A * 8/1976 Carter ..... 417/423.12
4,367,140 A * 1/1983 Wilson ..... 417/377
4,487,299 A * 12/1984 Bookout ..... 310/87
5,211,544 A * 5/1993 Klumpp et al. ..... 417/286
5,828,149 A * 10/1998 Parmeter et al. ..... 417/423.3
6,017,198 A * 1/2000 Traylor et al. ..... 417/366
6,132,177 A * 10/2000 Loprete et al. ..... 417/221
6,422,346 B1 * 7/2002 Gilbert ..... 184/6.16

* cited by examiner

*Primary Examiner*—Cheryl J. Tyler
(74) *Attorney, Agent, or Firm*—Van Someren, P.C.; Jeffrey E. Griffin; Brigitte Jeffery Echols

(57) ABSTRACT

A component, such as a submersible motor, having a lubrication distribution system. The component includes an outer housing having a rotatable shaft disposed within the housing. The shaft is supported by one or more bearings and a lubricant is disposed within the housing. A conduit is provided for conducting a lubricant from the lubricant pump to desired locations, such as the one or more bearings.

22 Claims, 5 Drawing Sheets

LUBRICATION SYSTEM FOR DOWNHOLE APPLICATION

FIELD OF THE INVENTION

The present invention relates generally to completions utilized in subterranean locations, and particularly to a lubrication system that may be used with components, e.g. a submersible motor, of a submersible pumping system.

BACKGROUND OF THE INVENTION

Production systems, such as electric submersible pumping systems, are utilized in pumping oil and/or other production fluids from producing wells. A typical electric submersible pumping system includes various components, such as a submersible motor, motor protector and a pump, e.g. a centrifugal pump. Additionally, a variety of other components may be combined with the system to facilitate the production of the desired fluid. Many of these components, such as the submersible motor, have moving parts that are subject to wear and require or benefit from lubrication.

A typical submersible motor, for example, often contains several bearing surfaces that are lubricated. With the submersible motor, a motor oil is used both to facilitate cooling of the motor and lubrication of the various surfaces benefiting from application of the motor oil. In some applications, however, it can be difficult to maintain uniform, consistent and plentiful application of the lubricant to certain surfaces, such as bearing surfaces.

SUMMARY OF THE INVENTION

The present invention relates to a technique for lubricating desired surfaces within certain components utilized in the movement of fluids. For example, the technique is readily adaptable to use with submersible motors and is designed to deliver a lubricating fluid to desired surfaces within the component.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

Figure 1:
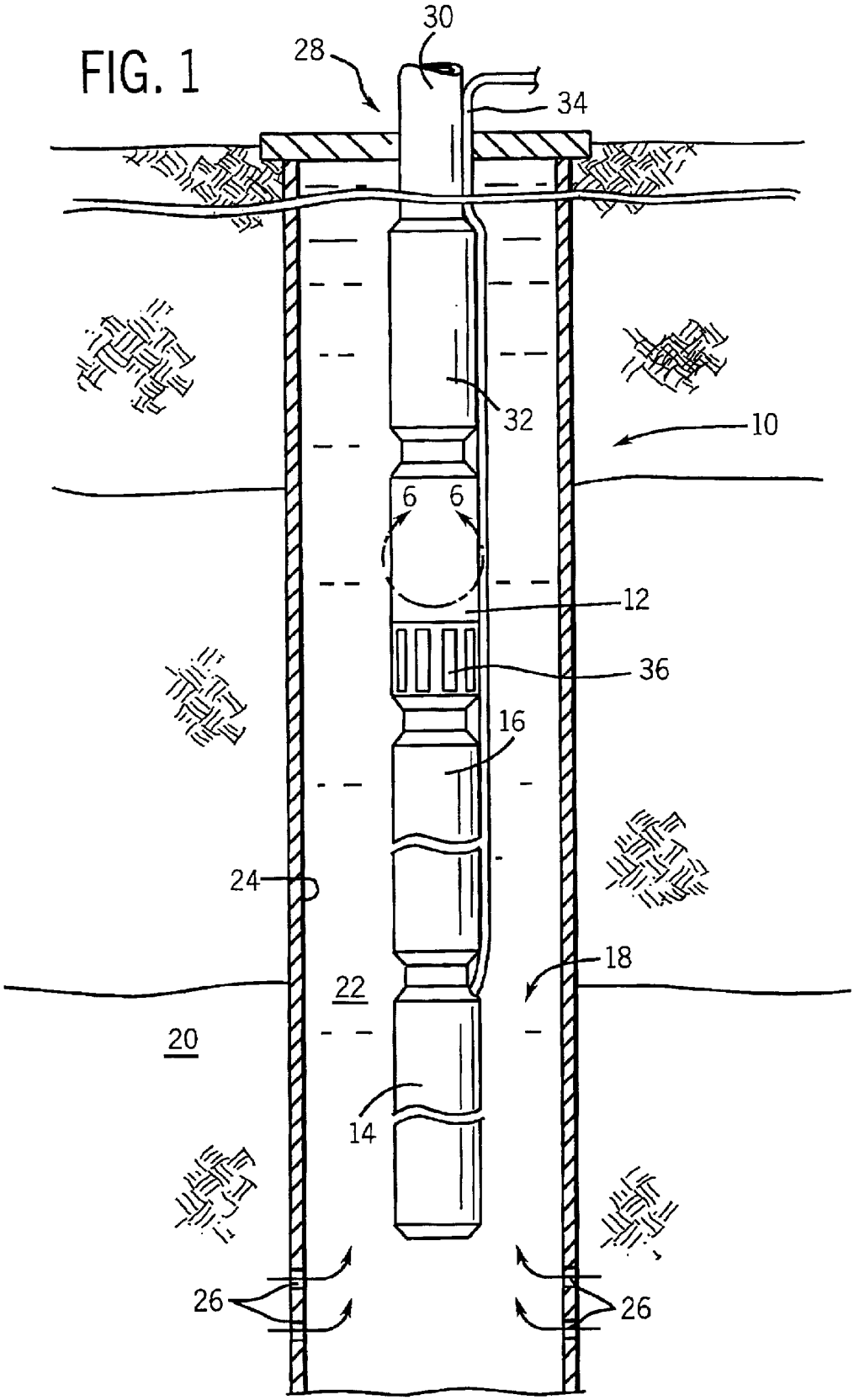
FIG. 1 is a front elevational view of an exemplary pumping system disposed within a wellbore.

Referring generally to FIG. 1, an exemplary system is illustrated that may have one or more components able to utilize the lubrication distribution technique of the present invention. Although the following description focuses primarily on distributing lubricant within a motor, such as a submersible motor, the technique can be utilized in a variety of other components and applications above or below the surface of the earth.

The exemplary application illustrated in FIG. 1 comprises an electric submersible pumping system 10. System 10 may utilize various components depending on the particular application or environment in which the system is utilized. Typically, system 10 comprises at least a submersible pump 12, a submersible motor 14 and a motor protector 16.

In the example provided, pumping system 10 is designed for deployment in a well 18 within a geological formation 20 containing desirable production fluids, such as petroleum. In a typical application, a wellbore 22 is drilled and lined with a wellbore casing 24. Wellbore casing 24 may include a plurality of openings 26, e.g. perforations, through which production fluids may flow into wellbore 22.

Pumping system 10 is deployed in wellbore 22 by a deployment system 28 that also may have a variety of forms and configurations. For example, deployment system 28 may comprise tubing 30 connected to pump 12 by a connector 32. Power is provided to submersible motor 14 via a power cable 34. Submersible motor 14, in turn, powers the submersible pump 12 which draws production fluid in through a pump intake 36 and pumps the production fluid to the surface via, for example, tubing 30. In other configurations, the production fluid may be produced through the annulus formed between deployment system 28 and wellbore casing 24.

Figure 2:
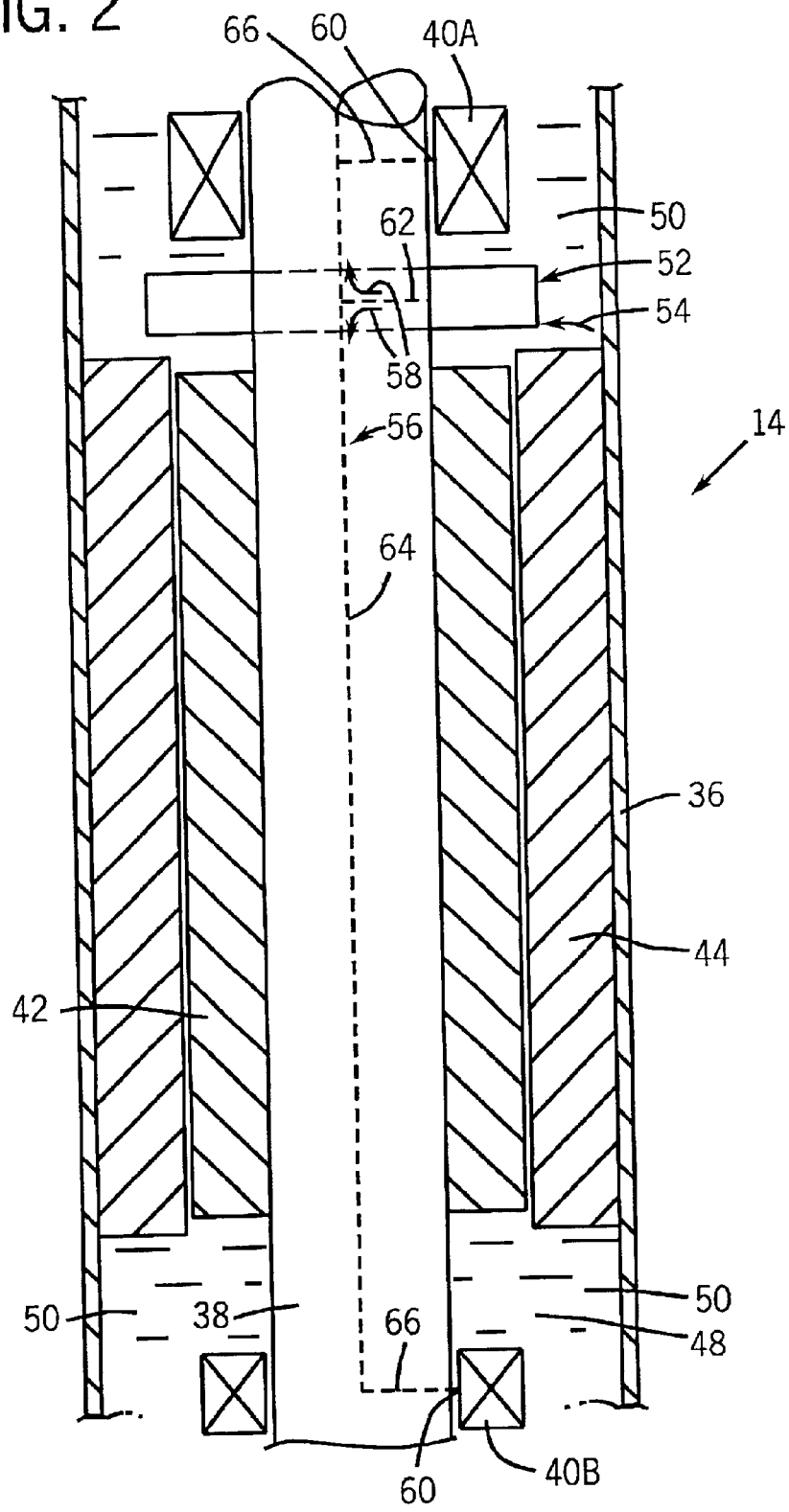
FIG. 2 is a schematic illustration of one exemplary layout of a pumping mechanism incorporated into a downhole component.

As illustrated in FIG. 2, an exemplary motor 14 typically comprises an outer housing 36 sized to fit within wellbore 18. A shaft 38 is rotatably mounted within outer housing 36 by, for example, a plurality of bearings 40. In the illustrated embodiment, the plurality of bearings 40 comprises an upper bearing 40A and a lower bearing 40B. However, a wide variety of bearing configurations may be utilized in which one or more bearings are mounted in cooperation with corresponding bearing journals. Thus, the illustrated embodiment provides an example for purposes of explanation and should not be construed as limiting the many possible bearing arrangements and configurations.

In the exemplary submersible motor 14, a rotor assembly 42 is mounted to shaft 38. A stator 44 is disposed about rotor assembly 42, as known to those of ordinary skill in the art. Often, stator 44 is mounted along an inside surface 46 of outer housing 36. Furthermore, the inside surface 46 may define the internal, open space or spaces 48 into which a motor lubricant 50 is deployed. An exemplary motor lubricant 50 comprises an oil, such as a dielectric oil.

Figure 3:
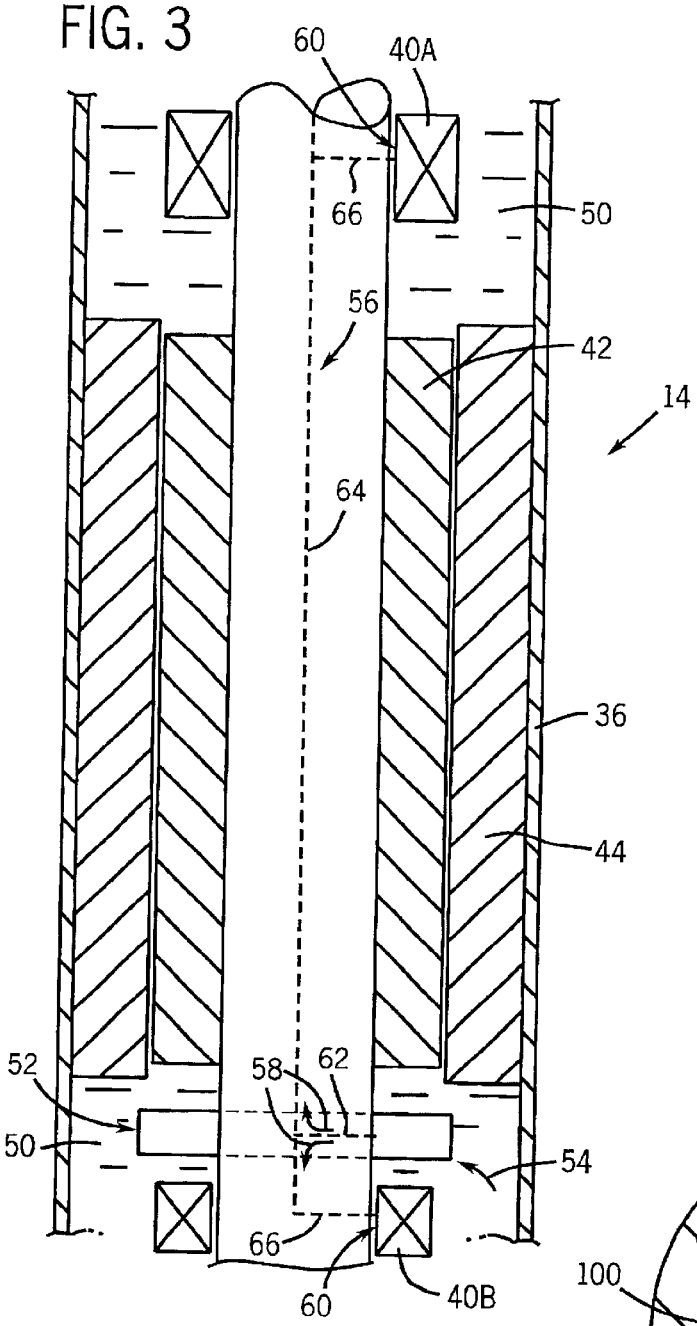
FIG. 3 is a schematic illustration of an alternate embodiment of the mechanism illustrated in FIG. 2.

A lubricant pump 52 is configured as an internal component of submersible motor 14 and deployed within outer housing 36. For example, lubricant pump 52 may be deployed about shaft 38 at an upper end of motor 14, as illustrated in FIG. 2. One alternative is to deploy lubricant pump 52 generally at a lower end of submersible motor 14, as illustrated best in FIG. 3. The location of lubricant 52 for a given component will depend on environment, application and/or design objectives for the component. Potentially, lubricant pump 52 can be mounted in a separate pump housing external to housing 36, e.g. at the bottom of housing 36, and in fluid communication therewith.

Generally, lubricant pump 52 draws lubricant 50 from internal space 48 (see arrow 54), pressurizes the lubricant and discharges the lubricant into a delivery conduit 56, as indicated by arrows 58. Delivery conduit 56 routes the lubricant to one or more desired locations 60, e.g. bearings 40A and 40B. In the illustrated embodiment, delivery conduit 56 comprises a passageway formed through shaft 38. For example, delivery conduit 56 may comprise a radial passage 62 that delivers lubricant radially inward from lubricant pump 52 to an axial passage 64 that facilitates disbursement of the lubricant along shaft 38. One or more radial delivery passages 66 direct the lubricant out of shaft 38 to desired locations 60, e.g. bearings 40A and 40B.

Figure 5:
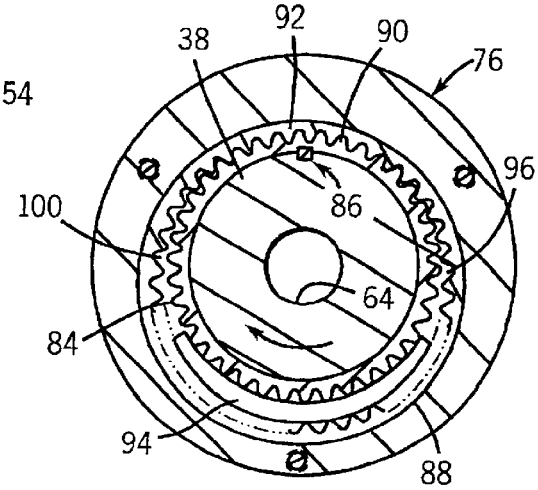
FIG. 5 is a cross-sectional view taken generally along line 5—5 of FIG. 4.
Figure 4:
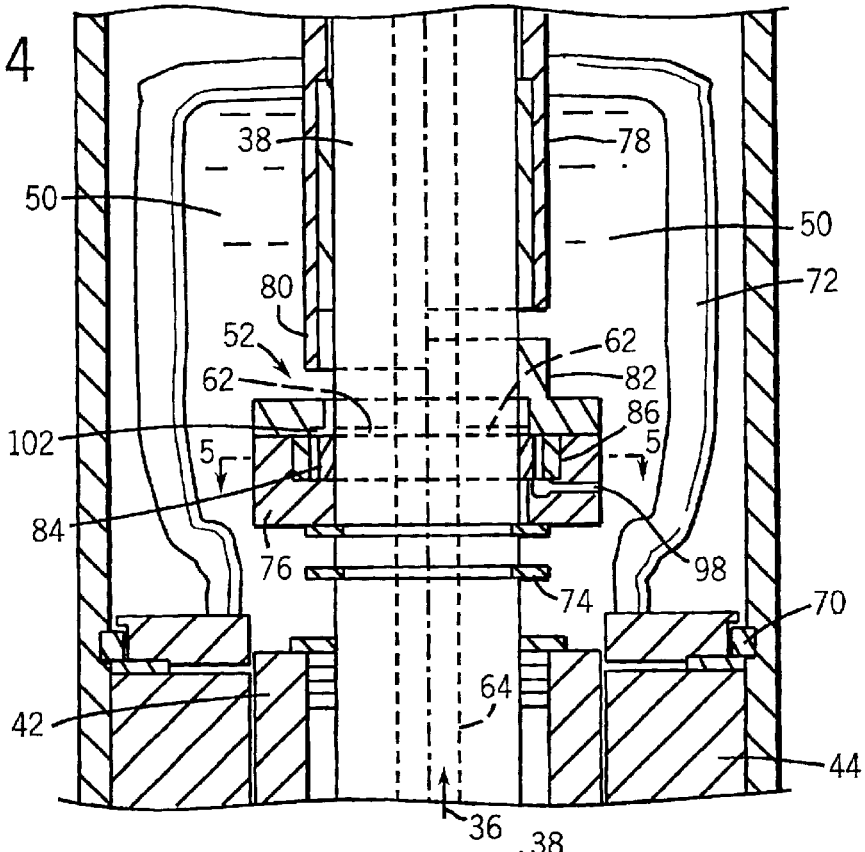
FIG. 4 is a cross-sectional view of a portion of the submersible electric motor illustrated in FIG. 1 showing an exemplary lubricant pumping mechanism.

As illustrated in FIGS. 4 and 5, lubricant pump 52 may be positioned between a snap ring 74 and a shaft guide tube 78. Snap ring 74 is disposed beneath a pump body or pump housing 76, and shaft guide tube 78 is disposed generally above lubricant pump 52. Shaft guide tube 78 includes a downwardly extended portion 80 positioned to abut a pump cover portion 82 of pump body 76. The interference between downwardly extended portion 80 and pump cover portion 82 prevents pump body 76 from rotating with shaft 38.

Within pump body 76, lubricant pump 52 comprises a drive gear 84 mounted to shaft 38. Drive gear 84 may be coupled to shaft 38 by, for instance, a key and keyway 86. Lubricant pump 52 also comprises a driven gear 88 that is rotatably mounted within pump body 76. Driven gear 88 encircles drive gear 84 and is coupled to drive gear 84 via drive teeth 90 and driven teeth 92. Drive teeth 90 and driven teeth 92 are engaged on one side of drive 84 and separated on the opposite side of drive gear 84, as best illustrated in FIG. 5. On the separated side, a gap is formed and preferably substantially filled by a web 94. Web 94 may be formed as a part of pump body 76 that extends upwardly between the inwardly disposed drive teeth 90 and outwardly disposed driven teeth 92.

As drive shaft 38 rotates, a low pressure area is created as the drive teeth 90 and driven teeth 92 disengage. This tends to draw lubricant 50 into a space 96 formed between drive gear 84 and driven gear 88 via a lubricant inlet cavity or passage 98 formed in pump body 76.

As the gears rotate, this lubricant, e.g. oil, is moved to the other side of the pump and pressurized in a space 100 formed between drive gear 84 and driven gear 88 proximate the position where drive teeth 90 move back into engagement with driven teeth 92. (In this example, space 96 is generally on the right hand side of the illustration in FIG. 5 and space 100 is on the left hand side of that same Figure.) As the teeth move together, the lubricant is pressurized and discharged through an appropriate lubricant outlet cavity or passage 102 formed in pump body 76. This pressurized fluid flows from cavity 102 radially inward through radial passage 62 of shaft 38. As described above, the oil flow is forced along delivery conduit 56, e.g. along axial passage 64 and radial delivery passages 66 of shaft 38. Thus, lubricant pump 52 is able to deliver lubricant to desired locations 60.

Figure 6:
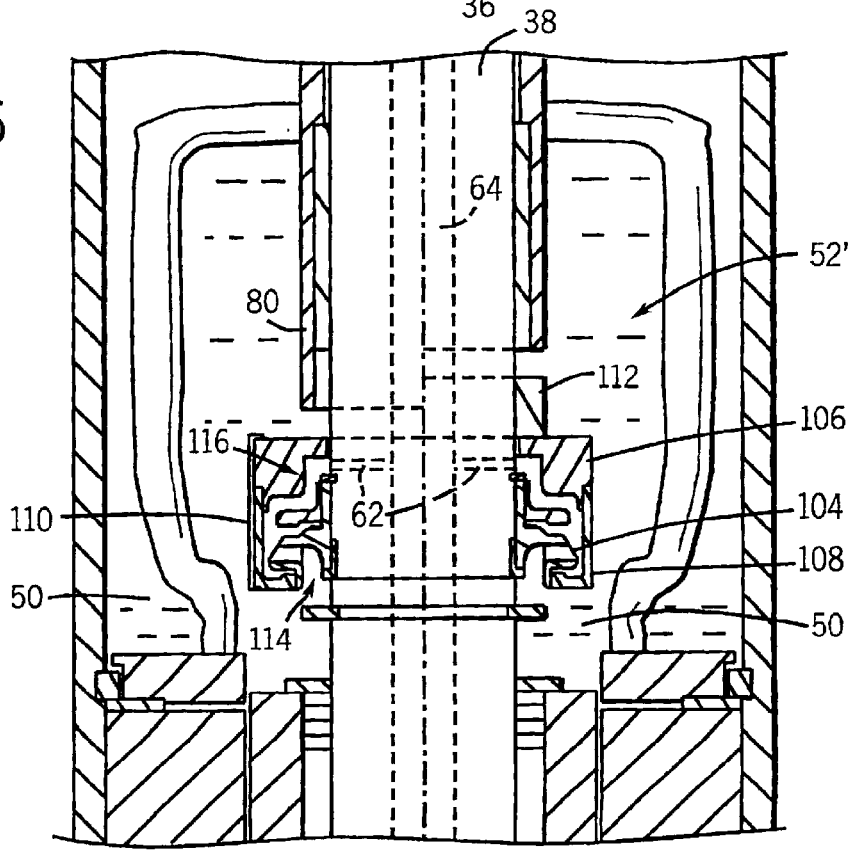
FIG. 6 is a view similar to FIG. 4 but showing an alternate embodiment of the lubricant pumping mechanism.

An alternate embodiment of lubricant pump 52, labeled 52', is illustrated in FIG. 6. Lubricant pump 52' comprises an impeller 104 captured between a top diffuser 106 and a bottom diffuser 108. One or more diffuser retaining clips 110 may be utilized to secure top diffuser 106 to bottom diffuser 108. Again, an upper extended portion 112 is disposed in an interfering relationship with downward extended portion 80 to prevent rotation of top diffuser 106 and bottom diffuser 108 during rotation of impeller 104.

As impeller 104 is rotated by shaft 38, lubricant 50 is drawn through an intake area 114 and discharged to a cavity 116 disposed in fluid contact with radial passage or passages 62. Thus, the pressurized fluid flows radially inward to axial passage 64 for distribution to desired locations 60. It should be noted that a variety of impellers or combinations of impellers may be utilized, and attachment of each impeller to shaft 38 may be accomplished by recognized methods, such as the use of a key and keyway (not shown).

Figure 7:
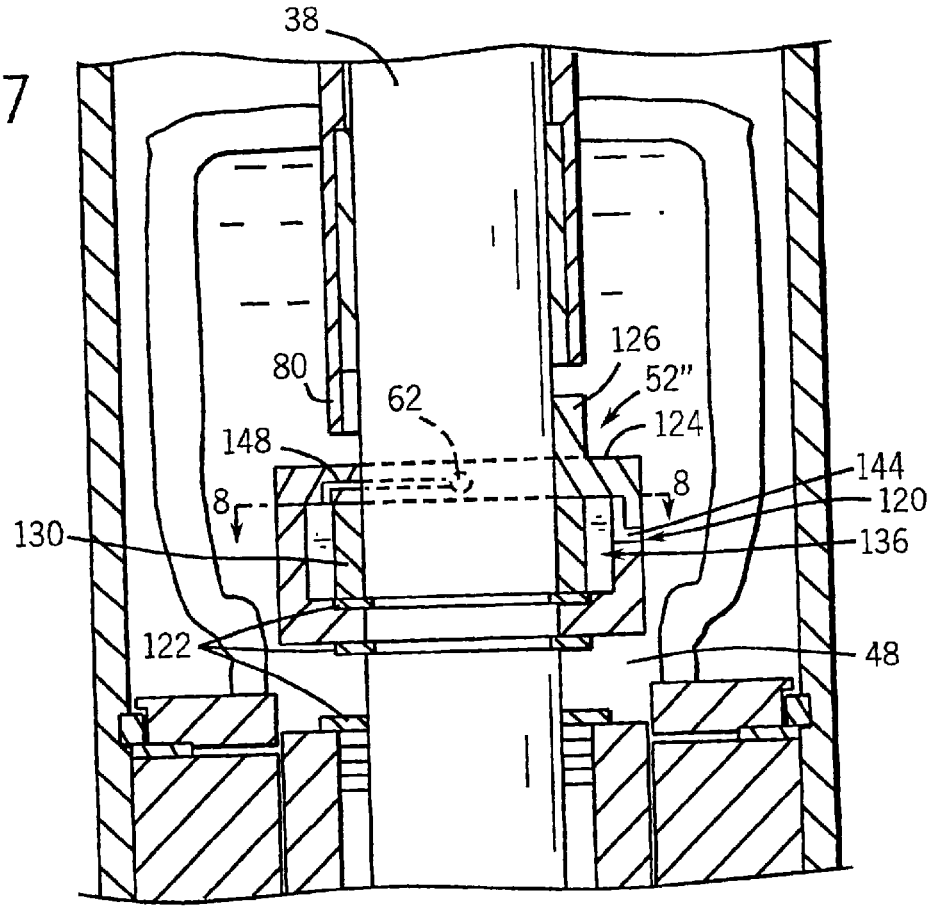
FIG. 7 is a view similar to FIG. 4 showing another alternate embodiment of the lubricant pumping mechanism.
Figure 8:
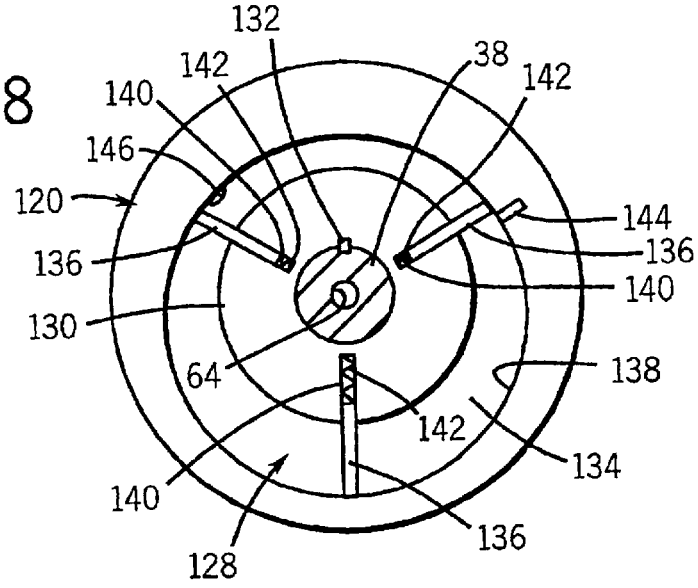
FIG. 8 is a cross-sectional view taken generally along line 8—8 of FIG. 7.

Referring generally to FIGS. 7 and 8, another exemplary embodiment of lubricant pump 52 is illustrated and labeled as 52". Lubricant pump 52" comprises a pump body 120 disposed about shaft 38 and held in axial position by a snap ring or typically a pair of snap rings 122. Snap rings 122 are positioned below and within pump body 120, as illustrated best in FIG. 7.

Pump body 120 further includes a cover portion 124 having an upward extension 126 disposed for interfering contact with portion 80 to prevent rotation of pump body 120 with shaft 38. Pump body 120 further includes an interior region 128 that serves as a cavity for receiving lubricant during pumping.

Interior region 128 is generally eccentrically shaped in cross-section, as best illustrated in FIG. 8. Disposed within interior region 128 is a pump rotor 130 mounted to shaft 38 by, for instance, a key and keyway assembly 132. Pump rotor 130 is positioned proximate one side of interior region 128 to form an oil pumping cavity 134.

Pump rotor 130 further includes a plurality of blades 136 that are mounted to reciprocate in a radial direction during rotation of pump rotor 130. Thus, blades 136 are maintained in cooperation with an interior surface 138 of interior region 128 during rotation of pump rotor 130.

In the exemplary embodiment illustrated, three blades 136 are slidably mounted within radial slots 140 formed in pump rotor 130. The blades 136 are biased outwardly towards interior surface 138 by, for instance, centrifugal force or a spring biasing member 142. Thus, as shaft 38 rotates, blades 136 are biased towards interior surface 138 of interior region 128.

During rotation of shaft 38 and pump rotor 130 in a clockwise direction, each blade 136 moves past a lubricant inlet 144 disposed in pump body 120 and exposed to lubricant 50 within internal spaces 48. As the blade 136 moves past inlet 144 and moves radially outward against interior surface 138, a low pressure region is created that draws lubricant into oil pumping cavity 134 through the lubricant inlet 144. The blades continue to move the drawn lubricant through cavity 134 until it is forced outward through a lubricant outlet 146 deployed in a narrower section of cavity 134. The lubricant is moved into a dispersion cavity 148 disposed in cover portion 124. Dispersion cavity 148 is located in fluid communication with radial passage 62 for distribution of the lubricant to desired locations 60.

It will be understood that the foregoing description is of exemplary embodiments of this invention, and that the invention is not limited to the specific forms shown. For example, the lubricant pump may be disposed at a variety of locations within the component housing; components other than submersible motors can utilize the lubricant dispensing technique; and a variety of pump styles may be mounted in one or more locations within a given component. The various pump styles may include pumps mounted about a drive shaft or elsewhere within a given component. Also, some designs may not utilize a drive shaft disposed therethrough. These and other modifications may be made in the design and arrangement of the elements without departing from the scope of the invention as expressed in the appended claims.

What is claimed is:

1. A motor, comprising:

a rotor and a stator disposed within a motor housing;

a rotatable shaft at least partially disposed within the motor housing;

a bearing that supports the rotatable shaft;

an internal lubricant pump disposed within the motor housing, the internal lubricant pump extending around the entire circumference of the shaft, the internal lubricant pump having a pump body with an eccentric oil cavity, and a pump rotor disposed in the eccentric oil cavity, and a conduit for conducting the lubricant from the internal lubricant pump directly to the bearing.

2. The motor as recited in claim 1, wherein the lubricant comprises an oil.

3. The motor as recited in claim 2, wherein the conduit is disposed in the rotatable shaft.

4. A motor, comprising:

a rotor and a stator disposed within a motor housing;

a rotatable shaft at least partially disposed within the motor housing;

a plurality of wear surfaces that support the rotatable shaft;

an internal lubricant pump disposed within the rotor housing, the internal lubricant pump extending around the entire circumference of the shaft, and a conduit for conducting the lubricant from the lubricant pump to the plurality of wear surfaces, wherein the lubricant pump comprises: a pump body having an eccentric oil cavity, and a pump rotor disposed in the eccentric oil cavity.

5. The motor as recited in claim 4, wherein the lubricant pump further comprises a plurality of blades slidably mounted to the pump rotor.

6. The motor as recited in claim 4, wherein the lubricant pump comprises an inner gear and an outer gear to provide a pumping action.

7. The motor as recited in claim 4, wherein the lubricant pump is disposed generally at an axial end of the motor housing.

8. The motor as recited in claim 4, wherein the lubricant pump comprises an impeller.

9. A submersible pumping system, comprising:

a submersible pump;

a motor protector; and a submersible motor having a gear pump to supply a pressurized lubricant to a bearing within the submersible motor, wherein the gear pump comprises first and second gears adapted to pressurize the lubricant.

10. The submersible pumping system as recited in claim 9, further comprising a conduit extending from the gear pump to the bearing.

11. The submersible pumping system as recited in claim 10, wherein the submersible motor comprises a rotatable shaft and the conduit is disposed at least partially within the shaft.

12. The submersible pumping system as recited in claim 9, wherein the pressurized lubricant comprises a dielectric oil.

13. A submersible motor, comprising:

an outer housing;

a rotatable shaft;

a stator disposed within the outer housing;

a rotor rotatably mounted within the stator;

a lubrication system to distribute a lubricant to one or more desired locations within the outer housing; and a gear pump comprising a pump body having an eccentric oil cavity, and a pump rotor disposed in the eccentric oil cavity, the gear pump being internal to the outer housing and external to the shaft, the gear pump adapted to pressurize the lubricant within the lubrication system.

14. The submersible motor as recited in claim 13, wherein the rotor is mounted on the shaft.

15. The submersible motor as recited in claim 14, wherein the lubrication system extends at least partially through the shaft.

16. The submersible motor as recited in claim 15, wherein the pump directs the lubricant along a pump flow path to an inlet formed on the shaft.

17. The submersible motor as recited in claim 13, wherein the lubricant pump comprises an inner gear and an outer gear to provide a pumping action.

18. A method for increasing the life expectancy of a subterranean completion having a submersible motor, comprising:

combining the submersible motor with a motor protector;

directing a flow of lubricant to an area of the submersible motor benefiting from lubrication;

pressurizing the flow of lubricant with a gear pump; and locating the gear pump above a rotor of the submersible motor.

19. The method as recited in claim 18, wherein directing comprises directing the flow of lubricant to a bearing.

20. The method as recited in claim 19, wherein directing comprises directing a flow of oil.

21. The method as recited in claim 18, wherein directing comprises directing the flow of lubricant along a conduit formed in a motor shaft.

22. The method as recited in claim 18, further comprising combining the submersible motor with a submersible pump.

* * * * *